US007500496B2

(12) United States Patent
Mettler

(10) Patent No.: US 7,500,496 B2
(45) Date of Patent: Mar. 10, 2009

(54) HEALD SHAFT FOR A WEAVING MACHINE

(75) Inventor: Franz Mettler, Wollerau (CH)

(73) Assignee: Groz-Beckert KG, Albstadt (DE)

( * ) Notice: Subject to any disclaimer, the term of this patent is extended or adjusted under 35 U.S.C. 154(b) by 411 days.

(21) Appl. No.: 10/555,108

(22) PCT Filed: Apr. 29, 2004

(86) PCT No.: PCT/EP2004/004546

§ 371 (c)(1),
(2), (4) Date: Nov. 2, 2005

(87) PCT Pub. No.: WO2004/097090

PCT Pub. Date: Nov. 11, 2004

(65) Prior Publication Data

US 2006/0249218 A1 Nov. 9, 2006

(30) Foreign Application Priority Data

May 2, 2003 (DE) ..... 103 19 959

(51) Int. Cl.
*D03C 9/06* (2006.01)
*D03C 9/00* (2006.01)

(52) U.S. Cl. ..... 139/91; 139/92

(58) Field of Classification Search ..... 139/91, 139/92
See application file for complete search history.

(56) References Cited

U.S. PATENT DOCUMENTS

| | | | | |
|---|---|---|---|---|
| 3,016,925 | A * | 1/1962 | Graf | 139/92 |
| 4,112,980 | A * | 9/1978 | Bader | 139/92 |
| 4,404,995 | A | 9/1983 | Bowen et al. | |
| 4,706,717 | A | 11/1987 | Root et al. | |
| 4,901,767 | A * | 2/1990 | Koch | 139/92 |
| 5,787,935 | A | 8/1998 | Mettler et al. | |
| 6,926,042 | B2 * | 8/2005 | Scheiwe | 139/91 |

FOREIGN PATENT DOCUMENTS

| | | |
|---|---|---|
| CH | 331474 | 9/1958 |
| DE | 1 799 695 U | 11/1958 |
| DE | 196 07 532 A | 9/1997 |

* cited by examiner

*Primary Examiner*—Bobby H Muromoto, Jr.
(74) *Attorney, Agent, or Firm*—Fitch, Even, Tabin & Flannery; Norman N. Kunitz

(57) ABSTRACT

For releasable attachment of heddle bars (8) to shaft rods (2) of a heald shaft (1) of a weaving machine, holding devices are provided which are composed of two sheet metal members, with one part forming a flat surface for bonding to the shaft rod (2). The parts that remains free receives respective metal ribs (31, 32), which may be riveted or welded to the sheet metal members. The reinforcing strips engage securing elements for a bracket to position the latter in a form-fitting manner. The sheet metal members are tightened against the bracket, e.g., by bolts or rivets, to firmly clamp the bracket in the desired position. The reinforcing strips are configured and secured to the sheet metal members such that the reinforcement simultaneously serves for the exact positioning of the bracket (22), and for preventing a vertical shift of the bracket during operation of the heald shaft.

13 Claims, 6 Drawing Sheets

HEALD SHAFT FOR A WEAVING MACHINE

CROSS-REFERENCE TO RELATED APPLICATIONS

This is a U.S. National Phase of International Application PCT/EP2004/04546, filed Nov. 2, 2005, and claims the benefit of foreign priority under 35 U.S.C. §119 based on German Application 103 19 959.4, filed May 2, 2003, the entire disclosures of which applications are hereby incorporated herein by reference.

The invention relates to a heald shaft for particular use in weaving machines.

Weaving machines include, for shed-forming, heald shafts supporting several healds which guide the warp threads. Such a heald shaft is known, for example, from DE 196 07 532 A1. The heald shaft includes an upper and a lower shaft rod oriented perpendicularly to the motion of the shaft. The two shaft rods which are held in a parallel-spaced relationship to one another are interconnected at their ends by so-called end binders. In this manner a frame is formed which is generally rectangular in front view. In the frame a respective shaft stave or heald (heddle) bar is secured to both the upper and the lower shaft rods. Between the shaft staves, healds are supported which are suspended by their end eyelets on the shaft staves or heald bars. Each heald is provided with a thread eyelet for the warp thread.

The shaft staves are provided with brackets for establishing a connection with the shaft rods. With each bracket connected with the shaft stave a socket is associated which is mounted on the shaft rod. Coupling devices serve for a form-fitting connection between each socket and the respective associated bracket. Each shaft rod has two flat sides and, arranged therebetween, a narrow side which is oriented toward the shaft stave. The sockets are screwed to the narrow side by bolts.

In such a heald shaft the connecting device according to a first embodiment is formed by a rectangular bolt which is, parallel to the shaft stave, pushed through openings in the socket and the bracket. According to another embodiment, the socket has an eyelet into which the bracket is hung in a hook-like manner. In both embodiments the connection between the bracket and the socket has a certain play. Such a support of the shaft stave on the shaft rod limits the speed range in which the heald shaft may be utilized.

Further, such a type of connection between the shaft stave and the shaft rod presupposes a massive structure of the shaft rod to ensure that the shaft rod may securely carry the bolts anchored in its narrow side.

U.S. Pat. No. 4,404,995 describes a heald shaft comprising shaft rods formed as hollow rectangular profile members. For securing the shaft staves, a leg projecting from a narrow side of the shaft rod is provided. The leg extends along the entire length of the shaft rod and is formed as a one-piece component therewith. The shaft stave is held on the leg by means of a rivet connection.

In such a construction the entire heald shaft has to be replaced when the shaft stave is worn. However, precisely in case of high-speed applications, wear of the shaft staves may occur after a relatively short operating period. Further, the longitudinally throughgoing leg adds to the weight of the heald shaft which may manifest itself during rapid motions of the heald shaft.

According to Utility Model No. 1 799 695 too, a fixed connection between the shaft rod and the shaft stave is provided. For this purpose, brackets are riveted to the shaft stave at one end and to the shaft rod at their other end. If the shaft staves are worn out, the entire heald shaft has to be replaced.

Further, JP 59-149982 discloses a heald shaft for a weaving machine, where the shaft rod is formed by a hollow rectangular profile member. Its wall oriented toward the shaft stave is thickened, so that mutually spaced holders may be sunk into the wall and anchored therein in a form-fit by means of a thickened head. The holders are angled at the bottom and are provided with threaded bores. In this heald shaft the shaft stave is screwed to the holders.

In such a solution the bores for the securing screws in the shaft stave and in the holders have to match with high precision.

For such a purpose, CH 331474 describes a heald shaft, whose shaft rods have a web which extends toward the shaft stave. Securing bolts are sunk into the web, onto which connecting brackets may be screwed for the shaft stave. The connecting brackets are provided with elongated holes for tolerance equalization.

It is common to the above solutions for a connection between the shaft stave and the shaft rod, inasmuch as such connection is based on a screw connection of sockets or a direct screw connection of the brackets, that the shaft rod must have a massive wall which may take up forces derived from a securing screw. Such a condition places limits on the structure of the heald shaft, particularly as concerns the choice of material and the wall thickness. This leads to a significant weight of the shaft rod, limiting the working speed of the weaving machine. Such considerations also apply to the solution according to the JP 59-149982.

It is accordingly the object of the invention to provide a heald shaft which provides for the possibility to construct particularly weight-saving heald shafts.

SUMMARY OF THE INVENTION

The above object generally is achieved with the heald shaft according to the present invention, wherein between its shaft stave and its shaft rod the heald shaft has at least two connecting devices spaced laterally from one another and each connecting the shaft stave or heald bar with the shaft rod. The connecting devices are components which are spaced and set off from the shaft rod and which are in a material-to-material bond with the shaft rod. Preferably, the connection is exclusively of the material-to-material type, that is, the connection is not supported by a form-fitting or like arrangement. The wall and possible inserts of the shaft rod are not affected. The material-to-material bond is furthermore purely superficial and at least linear, but preferably two-dimensional. In this manner a force introduction into the outer skin of the shaft rod is effected, without the need for providing the skin with apertures or breaches. The connection is thus preferably obtained on a closed surface of the shaft rod. By these measures wide possibilities are obtained for the shape-forming of the shaft rod, particularly as concerns the choice of its material and its internal structure. For example, the shaft rod may be made of a fiber-reinforced synthetic material, for example, carbon fiber-reinforced or fiber glass-reinforced plastic for obtaining high strength with small weight.

The mechanical connection of the shaft rod with the replaceable shaft stave is effected by means of brackets which constitute the connecting element or form part thereof. They are connected in a material-to-material bond with the shaft rod directly in a first arrangement and indirectly, by means of a socket, in a second arrangement. This principle may also be utilized in case the shaft rod has a differently structured light construction. It may be, for example, a metal honeycomb structure. Such a shaft rod is formed, for example, by two parallel-spaced sheet metal members (preferably of steel), between which a honeycomb structure, for example, a hexagonal honeycomb structure made of thin sheet metal or plastic-reinforced paper is placed. The gap between the two sheet metal members at their upper and lower ends may be closed off by plastic elements. The connecting device straddles the shaft rod preferably on both sides, so that two leg-like extensions receive the shaft rod between themselves and lie against its flat sides. The connection may be effected, for example, by a two-dimensional gluing or by applying weld seams. The laser weld seams may extend along the edge of the extension similarly to a hem. They may, however, also extend over the surface of the extension. In any case, the connection is, in this instance, limited to one or more strip-like regions. This, however, is sufficient for a force transmission even if the shaft rod is an extremely light metal structure (structures with foamed intermediate spaces).

The weld connection may be made by means of laser or electron beam. In case the shaft rod is a fiber-reinforced synthetic material, the gluing of the connecting device or the lamination or gluing thereof into the fiber-reinforced plastic body occurs without damaging the fibers, thus ensuring the strength of the body.

In case the shaft rod is a profile member made of a synthetic material, the connecting device may be sunk into the shaft rod and glued thereto. In this manner too, a good force transmission may be ensured. The connection between the connecting device and the shaft rod is made preferably in this case too, only by a material-to-material bond, rather than by a form-fit, for obtaining a possibly two-dimensional force introduction.

The connecting device is made preferably of two parts: it is subdivided into a bracket and a socket which are releasable attached to one another. This provides for the possibility to connect the socket, on the one hand, and the bracket, on the other hand, unreleasably with the shaft rod and, respectively, with the shaft stave, i.e., the heald bar. Between the socket and the heald bar a preferably play-free coupling means is effective. For example, a form-fit as well as additionally a clamping effect may be utilized. Such a solution is feasible by providing that the socket has, for example, two legs which define between themselves a receiving space for a coupling section of the bracket. With the legs a tightening means may be provided for firmly clamping the coupling section, whereby the latter is held play-free in its coupling position. Such connections make possible the transmission of forces which appear at high operating speeds and thus at large accelerations. The resulting firm and play-free connection between the shaft stave and the shaft rod permits large machine rpm's.

On the other hand, it is possible to release the shaft stave or heald bar without damaging the shaft rod and to accurately secure new shaft staves. The latter is particularly feasible if the connecting device defines the coupling position by a form-fit. Such a definition of position by a form-fit, however, preferably does not affect the longitudinal position of the shaft stave. This may be achieved by providing at the socket a rib as the form-fitting element. The rib extends parallel to the shaft rod and is associated with a groove formed in the coupling section. In the alternative, a groove may be provided in the socket, and the coupling section of the bracket may carry a corresponding rib. In both cases a certain longitudinal play is possible which makes simple a replacement of the shaft stave. The coupling sections of the brackets merely have to be pushed into the respective sockets, and then the tightening means provided on the sockets need to be tightened.

The connecting device may be entirely or partially made of a synthetic material. For example, the socket and/or the bracket may be a synthetic material. Such a material dampens and changes oscillations which are imparted to the shaft stave by the healds. The oscillations are transmitted to the shaft rod not in their full effect and thus reduce the stress thereon. Further, such measure results in noise dampening.

Further details of advantageous embodiments of the invention are disclosed in the Figures, the description in conjunction with the Figures or the dependent claims. The drawings illustrate embodiments of the invention.

DETAILED DESCRIPTION OF THE INVENTION

Figure 1:
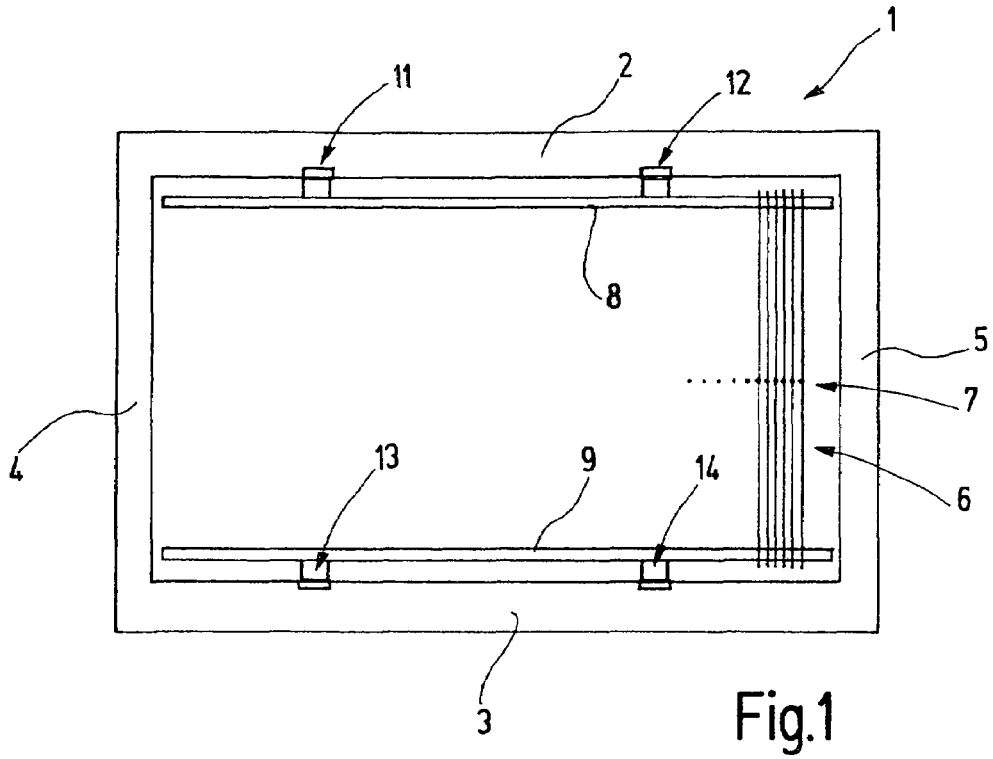
FIG. 1 is a schematic front elevational view of a heald shaft for a weaving machine.

FIG. 1 illustrates a heald shaft 1, comprising an upper shaft rod 2 arranged horizontally as a rule, and a shaft rod 3 held parallel to the shaft rod 2 and spaced therefrom. At their ends, the shaft rods 2 and 3 are interconnected by side binders 4, 5, whereby the latter form a rectangular frame together with the shaft rods 2, 3. In the frame a plurality of parallel healds 6 are arranged, each provided with a thread eyelet 7 for guiding a warp thread. The healds 6, arranged parallel to the side binders 4, 5, each have at their upper and lower ends a respective eyelet, by means of which they are supported on a shaft stave or heald bar 8, 9. The heald bars 8, 9 extend parallel to the respective adjoining shaft rods 2, 3 and are held at a distance therefrom. For this purpose connecting devices 11, 12, 13, 14 are provided, each of which establishing a releasable connection between the respective shaft rod 2, 3 and the associated heald bars. With each heald bars at least two connecting devices 11, 12 and, respectively, 13, 14 are associated. In the description which follows, the connecting device 11 will be set forth as an example for the other connecting devices 12, 13, 14. Parts of the description which relate to the shaft rod 2 equally apply to the shaft rod 3.

In the embodiment of the heald shaft 1 shown in a fragmentary manner in FIG. 1, the shaft rod 2 is a profile member of light construction. It comprises two flat bodies, for example, sheet metal members 15, 16 made, for example, of special steel, which are held parallel to and spaced from, one another to form the flat sides of the shaft rod 2. Between the sheet metal members 15, 16 spacers are provided which may be constituted by a honeycomb structure 17, glued or otherwise connected with the sheet metal members 15, 16. For outwardly closing off the inner space enclosed by the sheet metal members 15, 16, at the upper and lower narrow side of the shaft rod 2 a respective, cross-sectionally rectangular or square synthetic body 18, 19 may be glued in.

Figure 3:
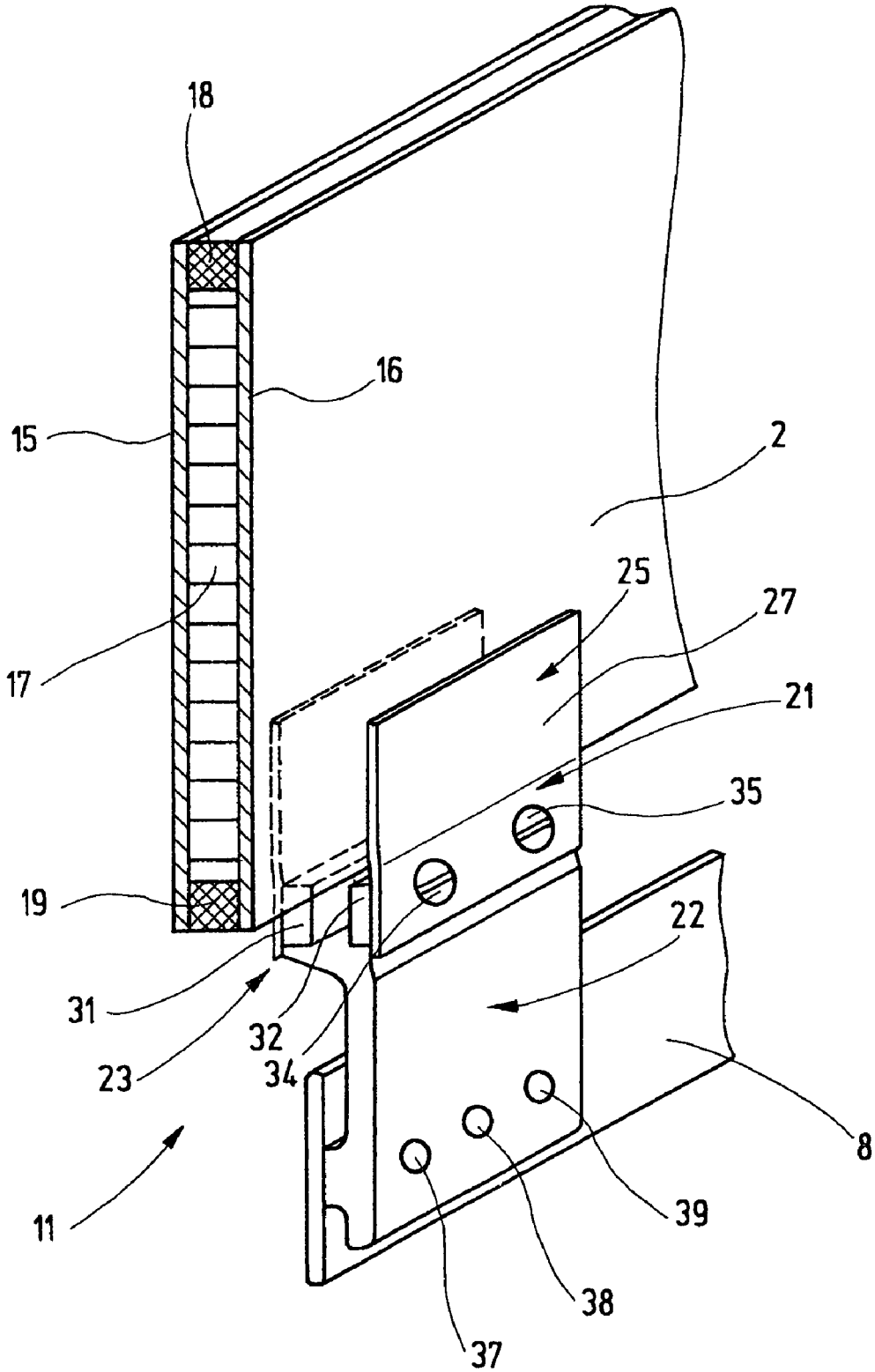
FIG. 3 shows the shaft rod of FIG. 2 on a different scale, together with hidden edges.

The connecting device 11, which is also particularly well seen in FIG. 3, comprises a socket 21 and a bracket 22 which are connected to one another by a coupling device 23.

Figure 4:
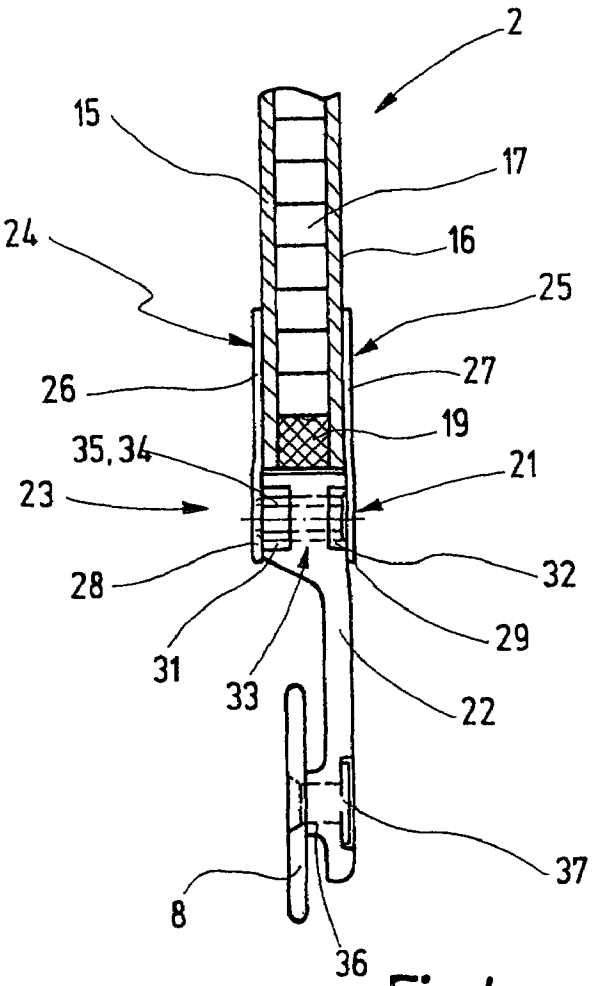
FIG. 4 is a sectional view of the shaft rod and the heald bar according to FIGS. 2 and 3.

The socket 21 is either a one-piece component or, as shown in FIGS. 3 and 4, is made of two parts, namely, a first socket element 24 and a second socket element 25, both formed by a flat leg. Each leg has a flat portion lying on the sheet metal member 15 or 16, respectively, and forming an anchoring portion 26, 27. The socket elements 24, 25, which together constitute the socket 21, are of mutually symmetrical construction. In the embodiment shown in FIGS. 3 and 4, their anchoring portions 26, 27 are glued to the sheet metal member 15 and, respectively, 16 in a face-to-face relationship therewith. In this arrangement the adhesive is situated in the junction between the anchoring portion 26 and the sheet metal member 15 and between the anchoring portion 27 and the sheet metal member 16. The adhesive serves for the material-to-material bond and for the transmission of longitudinal forces which lie in the drawing plane of FIG. 4 and are oriented downward.

The socket elements 24, 25 which are shown in FIGS. 3 and 4 as independent, separate elements, may also be interconnected by a web which, in such a case, lies against the lower synthetic body 19 or defines a gap therewith. In the illustrated embodiment the legs 28, 29 of the socket elements 24, 25 project beyond the lower narrow side of the shaft rod 2. The legs 28, 29 may resiliently move toward or away from one another, wherein a possible spring stroke of a few tenths of a millimeter is amply sufficient. The legs 28, 29 form one half of the coupling device 23 which serves for attaching the bracket 22. For this purpose, the legs 28, 29 carry, on their sides facing one another, web-like ribs 31, 32 which have, for example, a rectangular cross section and which extend parallel to the length dimension of the shaft rod 2, that is, perpendicularly to the drawing plane of FIG. 4. Further, the ribs 31, 32 are oriented parallel to one another and define a distance from one another as well as from the shaft rod 2. The ribs 31, 32 are firmly attached to the legs 28, 29, for example, by means of rivets or welds. Their cross section may also be of trapezoidal or other shape.

The bracket 22 is provided with a coupling section 33 which constitutes the other half of the coupling device 23. The coupling section 33 has a rectangular basic profile which, on its opposite flat sides, is provided with grooves in which the ribs 31, 32 are received with a precise fit. In this manner the coupling section 33 has an I-shaped or an H-shaped cross section which fits with a slight play between the legs 28, 29. Thus, the coupling section 33 may be pushed in between the legs 28, 29 in the longitudinal rib direction, that is, perpendicularly to the drawing plane of FIG. 4 for first establishing a form-fitting connection between the bracket 22 and the socket 21.

Securing bolts 34, 35 (see FIGS. 2, 3) are provided for tightening the bracket 22 to the socket 21. The securing bolts 34, 35 which pass through the legs 28, 29 and the coupling section 33, sit in bores or threaded bores which preferably pass through the ribs 31, 32. The rib 31 is preferably slightly thicker than the rib 32 for obtaining a sufficient height to form a threaded bore.

The securing bolts 34, 35 form tightening means for tightening the legs 28, 29 to one another and thus to the coupling section 33 and for firmly clamping the latter without play.

Figure 2:
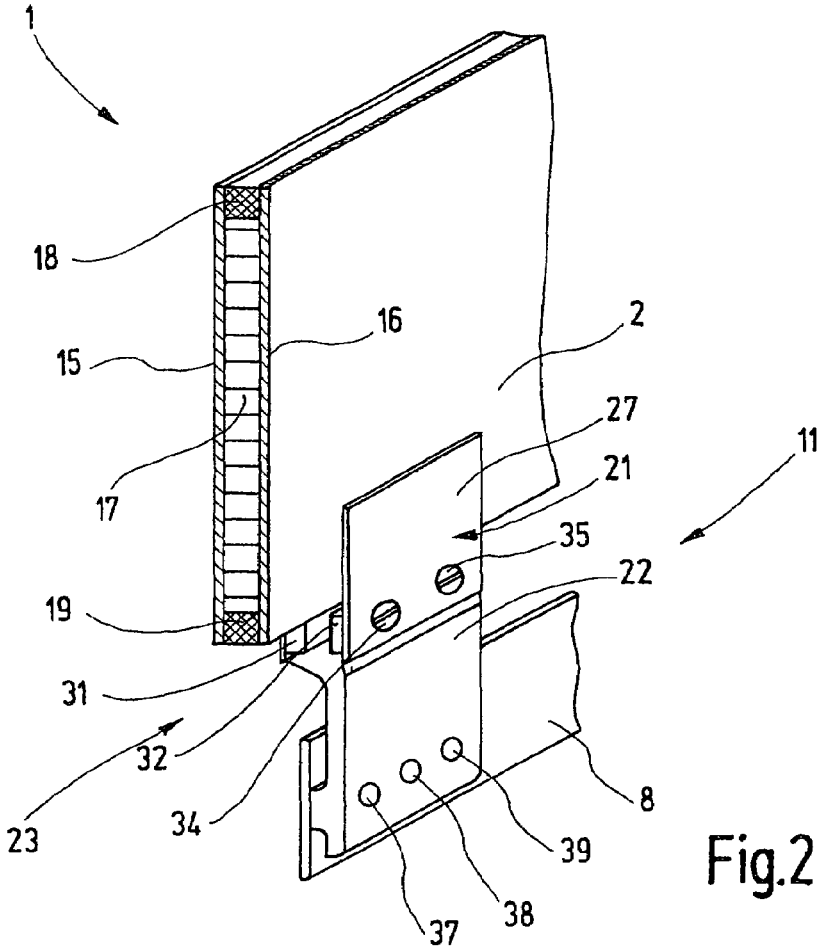
FIG. 2 is a fragmentary sectional perspective view of the heald shaft according to FIG. 1.

A flat portion of the bracket 22 extends away from the coupling section 33 preferably eccentrically, that is, approximately in the plane of the sheet metal member 16. The flat portion, similarly to the entire reminder of the bracket 22, may be made of a synthetic material or a light metal, such as aluminum. At its free end the bracket is provided with a projection 36 which is oriented toward a plane defined by the sheet metal member 15. The projection 36 serves as an engagement face for the heald bar 8 which is a flat profile member having rounded edges. The projection and the heald bar are provided with aligned openings into which a rivet 37 is inserted for establishing a firm connection. As shown in FIGS. 2 and 3, additional rivets 38, 39 may be provided.

Operation:

During operation, the heald bars 8, 9 are firmly held on the shaft rods 2, 3 by the connecting devices 11, 12, 13, 14. The sockets 21 are glued to the shaft rods 2, 3. The brackets 22 are firmly tightened by form-fit and friction between the legs 28, 29 by the coupling devices 23. The force introduction of the forces emanating from the shaft stave 8 occurs superficially into the surfaces 15, 16. The inner structure of the shaft rods 2, 3 is not affected by such forces.

After a certain operational period the shaft stave or heald bar 8 may exhibit signs of wear. It may be replaced in the simplest manner by releasing the coupling device 23 by removing the securing bolts 34, 35. The heald bar may then be uncoupled by moving it slightly longitudinally. During such an occurrence the coupling section 33 slides out of the intermediate space enclosed by the legs 28, 29 and is thus set free. A new heald bar with new brackets 22 may be inserted in a reverse order and again tightened.

In such a heald shaft the heald bars 8, 9 may be replaced as needed. The shaft rods 2, 3 are not affected by such a replacement and therefore, if needed, they may be made of a more expensive light construction material.

Figure 10:
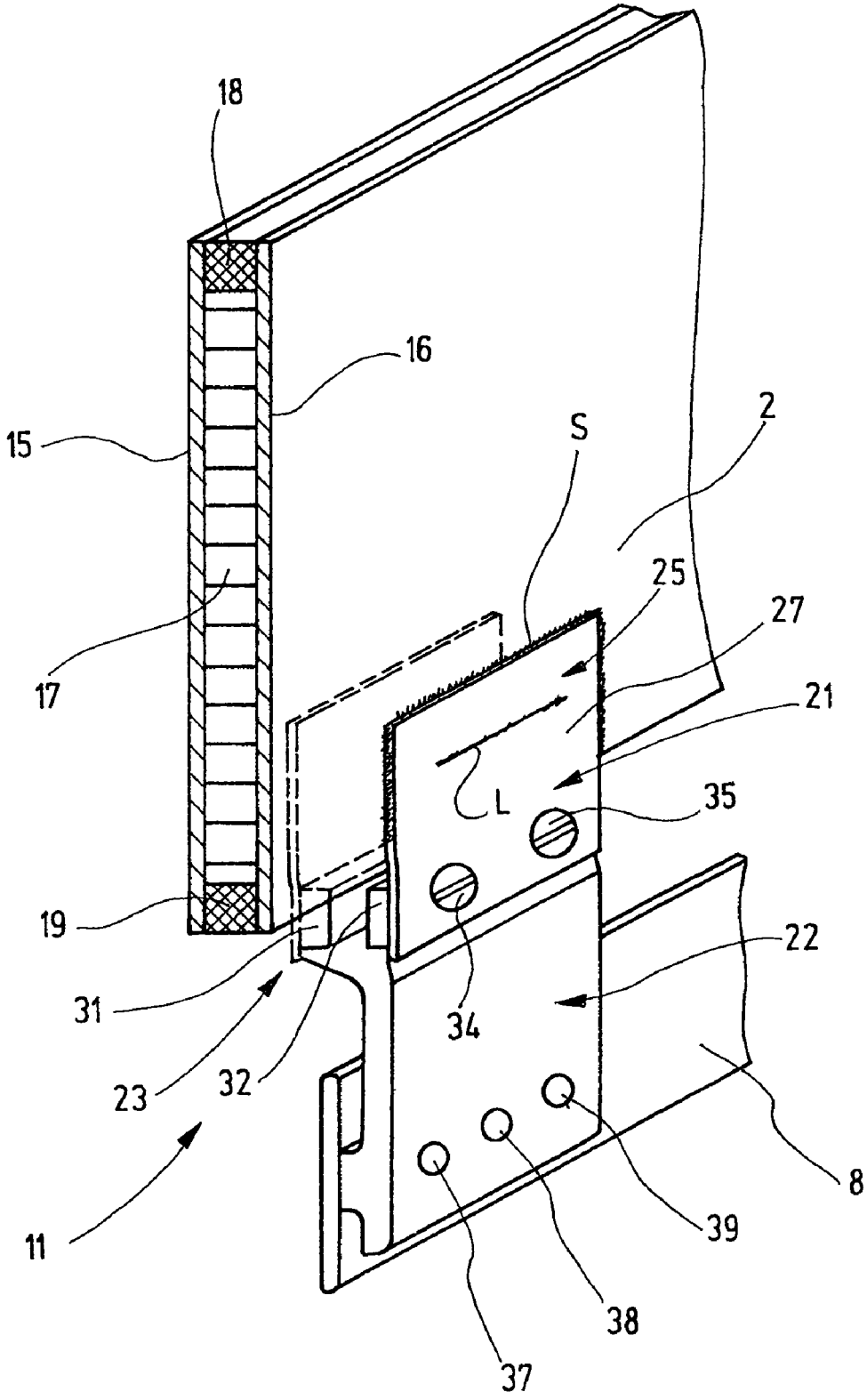

In a modified embodiment which has the basic structure of the embodiment shown in FIGS. 1 to 4 and is separately shown in FIG. 10 using the same reference numerals, the anchoring portions 26, 27 of the socket elements 24, 25 are secured to the sheet metal members 15, 16 not by gluing but by weld seams S. The latter may extend along the outer edge of the anchoring portions 26, 27. They also may be in the form of one or more parallel lines L extending over the surfaces of the anchoring portions 26, 27.

Figure 5:
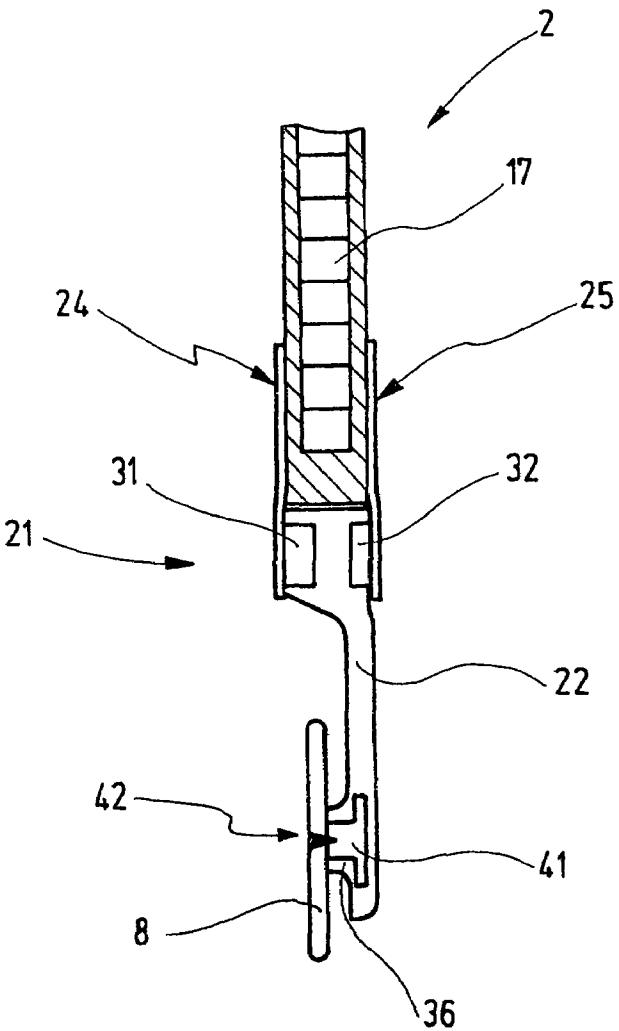
FIGS. 5 to 10 are fragmentary sectional illustrations of modified embodiments of the heald shaft.
Figure 6:
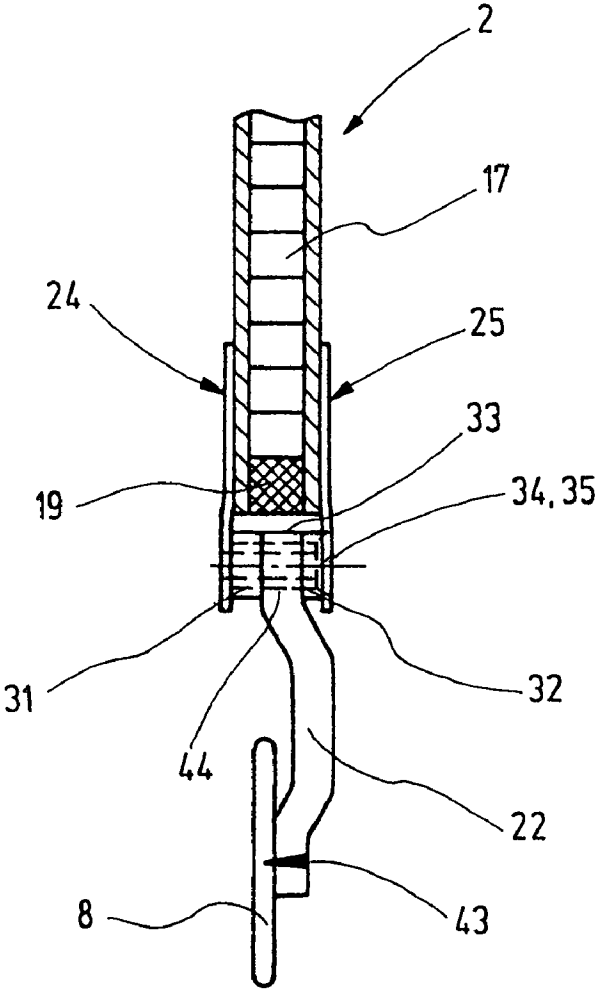

FIG. 5 shows a shaft rod 2 and a shaft stave or heald bar 8 of a modified embodiment of the heald shaft. The previous description applies in its entirety to the shaft rod 2 and the socket 21. For improving the clarity of illustration, the securing bolts 34, 35 are not shown. The bracket 22 is made of a synthetic material. It is provided with a metal insert 41 in the region of its projection 36. As shown, the heald bar 8 may be secured to the metal insert 41 by a weld seam 42 or a series of individual weld dots. A further modified embodiment is shown in FIG. 6. Inasmuch as in the description which follows, differences are not expressly pointed out, the description pertaining to FIGS. 1 to 4 applies, while using the same reference numerals.

The bracket 22 is formed by a bent steel band which is connected at its lower end with the shaft stave or heald bar 8 by a weld seam 43. The weld seam may be formed by starting at the bracket 22 as shown or, if required, at the heald bar 8. The bend in the bracket 22 provides for the necessary free space between the heald bar 8 and the bracket to receive the end eyelets of the healds. At its upper end, the bracket has bores 44 for the securing bolts 34, 35. The thickness of the bracket 22 corresponds to the distance between the ribs 31, 32. The bracket 22 is firmly clamped by friction between the ribs 31, 32. This arrangement dispenses with a lock based on a form-fit, as achieved by the part of the coupling section 33 straddling the ribs 31, 32 at the top and bottom. The upper end of the bracket 22 nonetheless forms a coupling section 33.

Figure 7:
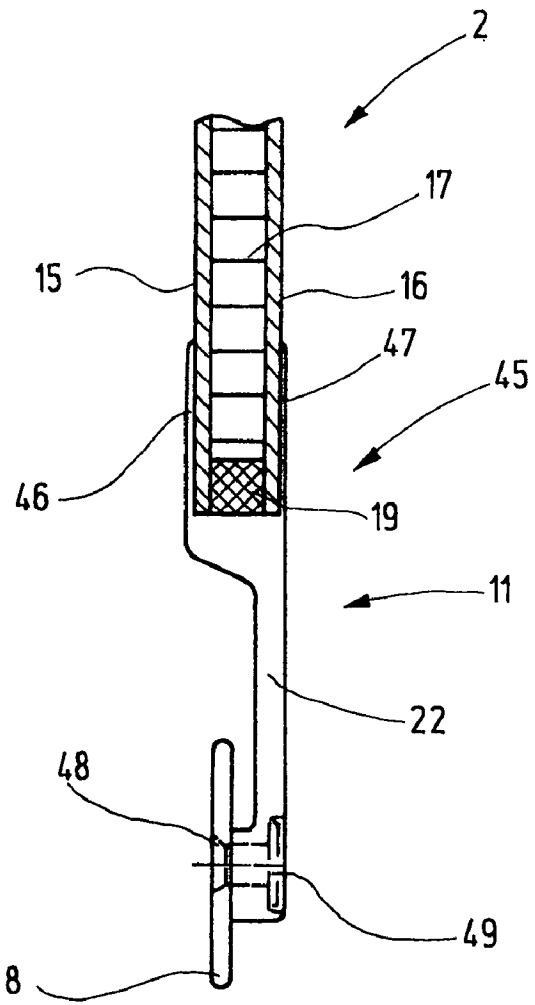

FIG. 7 illustrates a further modified embodiment. Its particularity resides in the one-piece construction of the connecting device 11, that is, the latter is not subdivided into socket and bracket. Rather, on the bracket 22 proper, which is preferably made of a synthetic material, a forked section 45 is formed, whose two legs 46, 47 straddle the shaft rod 2 at its flat sides. In this manner, the legs 46, 47 lie against the sheet metal members 15, 16 and are glued two-dimensionally thereto. Here, too, the heald bar 8 is attached to the lower end of the bracket 22. Preferably, for this purpose, instead of a rivet 37, a screw 48 having a countersunk head is used which is secured in a threaded bore having a metal wall and/or in a threaded bore of a metal insert 49 of the connecting device 11. An adhesive connection with the sheet metal members 15, 16 may also be made. In the alternative, a weld connection is also feasible.

Figure 8:
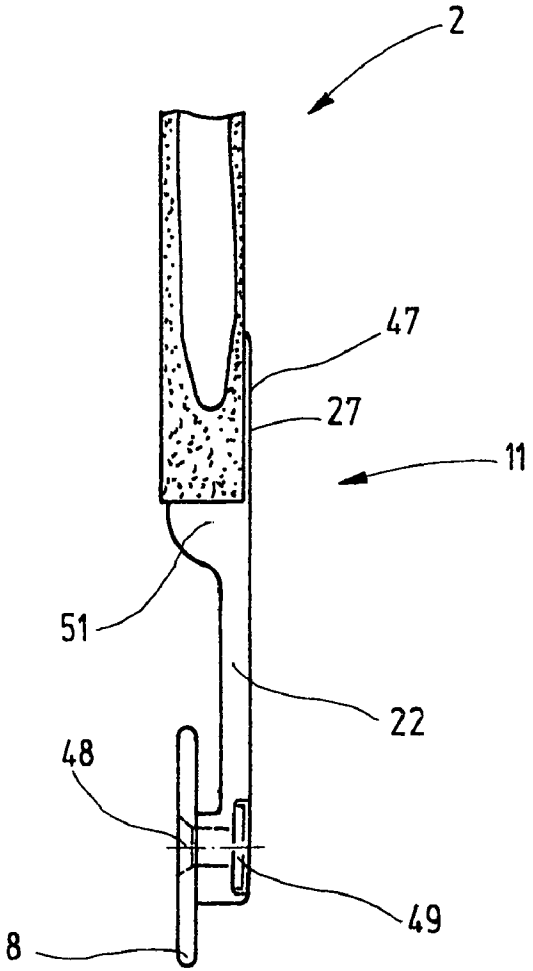

FIG. 8 shows a further modified embodiment of the invention. While in all the previously discussed embodiments a symmetrical force introduction into the sheet metal members 15, 16 occurs, the force introduction in the embodiment according to FIG. 8 is asymmetrical. The connecting device 11 which is, for example, a plastic or metal element, has but a sole leg 47 which is glued to the shaft rod 2, made in this case of a fiber composite. Further, the bracket 22 may be provided with a projection 51 which straddles the lower narrow side of the shaft rod 2 and which, with an upper engagement face, lies against the lower narrow side of the shaft rod 2 and is glued thereto at that location. In other respects the description in conjunction with FIG. 7 applies.

Figure 9:
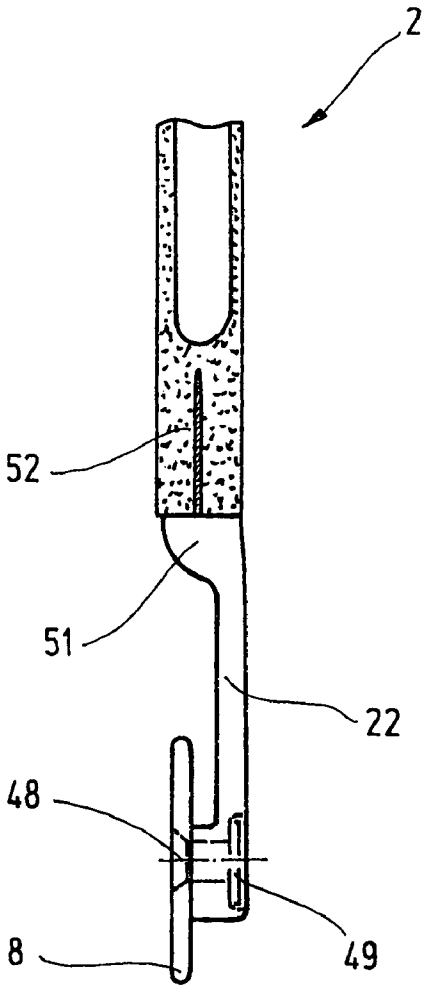

In the embodiment illustrated in FIG. 9, the shaft rod 2 is a fiber composite, similarly to the embodiment according to FIG. 8. It may be a hollow profile member or an internally foamed profile member. For connection with the bracket 22, the projection 51 of the latter may be formed as a lance-like extension 52 which is embedded into the synthetic material of the shaft rod 2. The extension 52 is preferably bordered by parallel flanks and is not undercut. It is laminated into the shaft rod 2. Additionally, legs 46 and/or 47 may be provided, similarly to FIG. 7 or 8. Also, from the projection 51 several extensions 52 may extend upward, which are oriented parallel or at angle to one another.

For a releasable attachment of shaft staves or heald bars 8 to shaft rods 2 of a heald shaft 1 of a weaving machine, holding devices are provided which, according to a preferred embodiment, are composed of two sheet metal members, of which one part forms an adhesive surface for bonding to the shaft rod 2. The part that remains free, that is, the free longitudinal edge of the sheet metal members, serves for receiving respective metal reinforcing strips (rib 31, 32) which may be riveted or welded to the sheet metal members. The reinforcing strips serve, on the one hand, to receive securing elements for a bracket and, on the other hand, to position the bracket. In this manner, the positioning is effected in a form-fitting manner. The sheet metal members are tightened against the bracket, preferably by bolts for firmly clamping the bracket in the position determined by the form-fit. In the alternative, rivets may also be used which, when required, may be released, for example, by pushing them out with simple tools. The reinforcing strips are configured and secured to the sheet metal members in such a manner that the reinforcement serves at the same time for the exact positioning of the bracket 22, for preventing, by a form-fit, a vertical shift of the bracket during operation of the heald shaft.

LIST OF REFERENCE CHARACTERS

1 heald shaft
2, 3 shaft rod
4, 5 side binders
6 healds
7 thread eyelet
8, 9 shaft stave
11, 12, 13, 14 connecting devices
15, 16 sheet metal members
17 honeycomb structure
18, 19 synthetic body
21 socket
22 bracket
23 coupling device
24, 25 socket element
26, 27 anchoring portion
28, 29 legs
31, 32 ribs
33 coupling section
34, 35 securing bolts
36 projection
37, 38, 39 rivet
41 metal insert
42, 43 weld seam
44 bore
45 section
46, 47 legs
48 screw
49 metal insert
51 projection
52 extension
S weld seams
L lines

The invention claimed is:

1. A heald shaft for weaving machines, comprising:

at least one shaft rod having two mutually parallel oppositely oriented flat sides;

at least one heald bar to which healds are to be secured with their end eyelets;

at least one connecting device releasably connecting the heald bar with the shaft rod;

and wherein the connecting device has at least one flat anchoring portion that is fastened to an outer surface of one of the flat sides of the shaft rod only by at least one of weld or glue bonding.

2. The heald shaft as defined in claim 1, wherein the connecting device has two flat anchoring portions, each of which is fastened to a respective outer surface of one of the two mutually parallel, oppositely oriented flat sides of the shaft rod only by at least one of weld or glue bonding, whereby the shaft rod is straddled by the anchoring portions of the connecting device.

3. The heald shaft as defined in claim 1, wherein the connecting device is welded to the shaft rod.

4. The heald shaft as defined in claim 1, wherein the connecting device is glued to the shaft rod.

5. The heald shaft as defined in claim 1, wherein each connecting device is composed of a bracket connected to the heald bar and a socket, which includes said flat anchoring portion, with the socket and bracket being releasably connected to one another.

6. The heald shaft as defined in claim 5, wherein the socket is unreleasibly connected with the shaft rod.

7. The heald shaft as defined in claim 5, wherein the bracket is unreleasibly connected with the heald bar.

8. The heald shaft as defined in claim 5, wherein the socket is connected with the bracket by a form-fit.

9. The heald shaft as defined in claim 5, wherein the socket has two legs which constitute two of said flat anchoring portions that are fastened to respective outer surfaces of said flat sides of said shaft rod and which define a receiving space between themselves for a coupling section of the bracket; and a tightening means for tightening the legs against one another for firmly clamping the coupling section.

10. The heald shaft as defined in claim 9, wherein a rib is formed on an inner surface of at least one of said legs, with the rib extending into the receiving space and parallel to the shaft rod and engaging into a groove provided in the coupling section to couple the bracket and socket.

11. The heald shaft as defined in claim 10, wherein a respective rib is formed on an inner surface of each of said legs, with both of the ribs extending into the receiving space and parallel to the shaft rod and engaging into respective grooves provided in the coupling section to couple the bracket and socket.

12. The heald shaft as defined in claim 10, wherein the respective ribs and grooves matingly engage to provide a form-fit connection.

13. The heald shaft as defined in claim 1, wherein the shaft rod is formed of two spaced mutually parallel oppositely oriented flat metal sheets forming the side walls of the shaft rod and defining a space there-between, respective spacer bars disposed between and connecting the upper and lower edges of the sheets together, and a honeycomb structure disposed in the space.

* * * * *